US009855598B2

(12) United States Patent
Winter

(10) Patent No.: US 9,855,598 B2
(45) Date of Patent: Jan. 2, 2018

(54) METHOD FOR PRODUCING ROLLING STOCK BY MEANS OF A COMBINED CONTINUOUS CASTING AND ROLLING SYSTEM, CONTROL DEVICE FOR A COMBINED CONTINUOUS CASTING AND ROLLING SYSTEM, AND COMBINED CONTINUOUS CASTING AND ROLLING SYSTEM

(75) Inventor: Günther Winter, Neunkirchen a. Brand (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/816,759

(22) PCT Filed: Jul. 28, 2011

(86) PCT No.: PCT/EP2011/062963
§ 371 (c)(1),
(2), (4) Date: Feb. 13, 2013

(87) PCT Pub. No.: WO2012/019917
PCT Pub. Date: Feb. 16, 2012

(65) Prior Publication Data

US 2013/0139992 A1 Jun. 6, 2013

(30) Foreign Application Priority Data

Aug. 13, 2010 (EP) ..... 10172748

(51) Int. Cl.
*B22D 11/12* (2006.01)
*B21B 1/46* (2006.01)
(Continued)

(52) U.S. Cl.
CPC ..... *B22D 11/12* (2013.01); *B21B 1/463* (2013.01); *B21B 37/24* (2013.01); *B22D 11/0622* (2013.01); *B22D 11/16* (2013.01)

(58) Field of Classification Search
CPC . B22D 11/16; B22D 11/0622; B22D 11/0631; B22D 11/0605; B22D 11/1282;
(Continued)

(56) References Cited

U.S. PATENT DOCUMENTS 4,248,072 A 2/1981 Hasegawa ..... 72/8.3
6,524,408 B1 2/2003 Schmitz et al. ..... 148/541
(Continued)

FOREIGN PATENT DOCUMENTS

CN 101443135 A 5/2009 ..... B21B 37/16
DE 19840898 A1 3/2000 ..... B21B 1/22
(Continued)

OTHER PUBLICATIONS

Hachmann, B. et al., "4.2 Walzen belastungsoptimierter Langsprofile," Umformtechnik. Aachener Stahlcolloauium, XP000856454, 6 pages (German), Jan. 1, 1992.
(Continued)

*Primary Examiner* — Kevin P Kerns
*Assistant Examiner* — Steven Ha
(74) *Attorney, Agent, or Firm* — Slayden Grubert Beard PLLC

(57) ABSTRACT

A combined continuous casting and rolling system, a control device for such system, and a method for producing rolling stock, e.g., metal strip, using such system are disclosed. The combined continuous casting and rolling system may include a casting device for casting metal and a roll train having at least one roll stand for hot forming the rolling stock, wherein the system is operated such that the rolling stock extends continuously between the casting device and
(Continued)

the roll train, wherein rolling stock is continually supplied to the roll train, and wherein a predetermined target thickness progression for the rolling stock is predetermined. Because the thickness progression has at least two different target thicknesses for different sections in the longitudinal direction of the rolling stock and the thickness progression is designed such that particular target thicknesses are set at least twice, longitudinally profiled rolling stock may be produced relatively inexpensively.

14 Claims, 3 Drawing Sheets

(51) Int. Cl.
*B21B 37/24* (2006.01)
*B22D 11/06* (2006.01)
*B22D 11/16* (2006.01)

(58) Field of Classification Search
CPC ..... B22D 11/05; B22D 11/12; B21B 1/46; B21B 1/463
USPC ..... 164/452, 476, 424, 479–484, 491
See application file for complete search history.

(56) References Cited

U.S. PATENT DOCUMENTS

| | | | | |
|---|---|---|---|---|
| 6,536,254 | B1 | 3/2003 | Kawalla et al. | 72/200 |
| 6,662,616 | B2 | 12/2003 | Böhlke et al. | 72/240 |
| 7,849,722 | B2 | 12/2010 | Britanik et al. | 72/9.2 |
| 2007/0012573 | A1* | 1/2007 | Sawada et al. | 205/153 |
| 2008/0035301 | A1* | 2/2008 | Arvedi | 164/460 |
| 2009/0139290 | A1 | 6/2009 | Britanik et al. | 72/9.2 |
| 2009/0306810 | A1* | 12/2009 | Koh | B21B 37/26 700/148 |
| 2010/0000705 | A1 | 1/2010 | Dixon et al. | 164/463 |
| 2010/0252223 | A1* | 10/2010 | Franz | B21B 1/463 164/131 |
| 2013/0139992 | A1 | 6/2013 | Winter | 164/452 |

FOREIGN PATENT DOCUMENTS

| | | | | |
|---|---|---|---|---|
| DE | 10041280 | A1 | 3/2002 | B21B 1/22 |
| EP | 1044734 | A2 | 10/2000 | B21B 1/22 |
| JP | 63040604 | A | 2/1988 | B21B 1/22 |
| WO | 00/13820 | A1 | 3/2000 | B21B 1/22 |
| WO | 00/21695 | A1 | 4/2000 | B21B 37/24 |
| WO | 2012/019917 | A1 | 2/2012 | B21B 1/46 |

OTHER PUBLICATIONS

Hauger, A., "Kostengünstiges Verfahern Durch Flexibles Walzen belstungsgerecht erzeugte Blechdickenprofile," Fertigung, Verlag Moderne Industrie, vol. 23, No. 10, XP001040097, 3 pages (German), Oct. 1, 1995.

Kopp, R., "Some Current Development Trends in Metal-Forming Technology," Journal of Materials Processing Technology, vol. 60, XP002614825, 10 pages, 1996.

Schwarz, N. et al., "Flexibel Gewalzte Bleche für belastungsangepasste Werkstücke," Werkstatt und Betrieb, Carl Hanser Verlag GmbH & Co. KG, vol. 131, No. 5, XP000776752, 4 pages (German), May 1, 1998.

Kopp, R. et al., "Belastungsangepasste Bleche durch Flexibles Walzen," VDI Z, Springer VDI Verlag, DE, Special Issue, XP000827017, 4 pages (German), Oct. 1, 1998.

International Search Report and Written Opinion, Application No. PCT/EP2011/062963, 20 pages, dated Oct. 12, 2011.

Chinese Office Action, Application No. 2011800390897, 17 pages, dated Jun. 26, 2014.

Chinese Office Action, Application No. 2011800390897, 15 pages, dated Jul. 28, 2015.

Mexican Office Action, Application No. MX/a/2013/001745, 7 pages, dated Oct. 21, 2015.

* cited by examiner

METHOD FOR PRODUCING ROLLING STOCK BY MEANS OF A COMBINED CONTINUOUS CASTING AND ROLLING SYSTEM, CONTROL DEVICE FOR A COMBINED CONTINUOUS CASTING AND ROLLING SYSTEM, AND COMBINED CONTINUOUS CASTING AND ROLLING SYSTEM

CROSS-REFERENCE TO RELATED APPLICATIONS

This application is a U.S. National Stage Application of International Application No. PCT/EP2011/062963 filed Jul. 28, 2011, which designates the United States of America, and claims priority to EP Patent Application No. 10172748.5 filed Aug. 13, 2010 The contents of which are hereby incorporated by reference in their entirety.

TECHNICAL FIELD

The disclosure relates to a method for producing rolling stock, in particular metal strip, by means of a combined continuous casting and rolling system, comprising a casting device for casting metal and a roll train comprising at least one roll stand for hot forming the metal, wherein the combined continuous casting and rolling system is operated such that the rolling stock extends continuously between the casting device and the roll train, wherein rolling stock is continuously fed to the roll train, wherein a target thickness progression according to which the roll train rolls the rolling stock is predetermined for the roll train. The disclosure further relates to a control device for a combined continuous casting and rolling system and to a combined continuous casting and rolling system for producing rolling stock that is thickness-profiled in its longitudinal direction.

BACKGROUND

The disclosure relates to the technical field of rolling rolling stock, in particular metal strip, in particular so-called "tailored blanks", i.e. rolling stock with a desired thickness profile in the longitudinal direction of the rolling stock. If the rolling stock is metal strip, such metal strip is also termed longitudinally profiled metal strip. The associated process is also known as flexible rolling. For various reasons explained below, flexible rolling is today only employed in the cold rolling sector. The products produced by this method are used, for example, in the automobile industry in order to increase passenger safety while at the same time minimizing the vehicle weight.

Published unexamined German patent application DE10041280A1 discloses a method for the flexible cold rolling of metal strip.

WO 00/13820 discloses a method for producing metal strips using a hot rolling process, wherein the strip thickness continuously changes in the longitudinal direction. This variable thickness is adjusted by means of a variable casting roll gap and cooling of the casting rolls. The disadvantage of this solution is that thickness settings cannot be controlled accurately and easily by means of the casting rolls. Moreover, only particular thickness progressions can be produced, thereby limiting the flexibility of the system.

Today, no production of "tailored blanks" takes place using conventional hot rolling trains, because the minimum hot strip thicknesses achievable generally range from 1.2 to 1.5 millimeters, which is insufficient for tailored blanks which often require minimum thicknesses of 0.6 mm. The required thickness range can therefore only be inadequately covered using conventional hot rolling trains for tailored blanks.

SUMMARY

One embodiment provides a method for producing rolling stock, in particular metal strip, by means of a combined continuous casting and rolling system, comprising a casting device for casting metal and a roll train comprising at least one roll stand for hot forming the rolling stock, wherein the combined continuous casting and rolling system is operated such that the rolling stock extends continuously between the casting device and the roll train, wherein rolling stock is continuously fed to the roll train, wherein a target thickness progression according to which the roll train rolls the rolling stock is predetermined for the roll train, wherein the thickness progression has at least two different target thicknesses for different sections in the longitudinal direction of the rolling stock, and that the thickness progression is designed such that the first and/or the second target thickness is set at least twice, wherein the combined continuous casting and rolling system is operated such that an infeed rate of the rolling stock to the roll stand is set to less than 7 meters per second, in particular less than 5 meters per second, in particular between 1 meter per second and 4 meters per second.

In a further embodiment, in addition to the at least two different target thicknesses, associated target roll forces and/or target roll gap openings are predetermined.

In a further embodiment, the thickness progression comprises repeating, in particular recurring changes in thickness in the longitudinal direction of the rolling stock.

In a further embodiment, a strip accumulator, in particular a loop of strip with which mass flow fluctuations caused by the predetermined thickness progression are equalized is provided between the casting device and the roll train.

In a further embodiment, the casting device is operated such that, by means of the casting device, the rolling stock has a predetermined actual thickness progression matched to the target thickness progression before it enters the roll train.

In a further embodiment, the roll train is followed in the mass flow direction by a thickness measuring device by means of which the rolled thickness of the rolling stock is detected, wherein at least one final control element for the roll train, in particular of at least one roll stand, is set as a function of the detected thickness and the predetermined thickness progression.

In a further embodiment, the roll train is followed in the mass flow direction by a flatness measuring device by means of which the flatness of the rolling stock is detected, wherein at least one final control element, in particular a bending cylinder, for the roll train, is set as a function of the detected flatness and a predetermined thickness progression.

In a further embodiment, the thickness progression is set using a roll train comprising a roll stand having a set of work rolls that have a diameter of less than 800 millimeters, in particular 200 to 600 millimeters.

In a further embodiment, the infeed rate is set and the roll stand designed such that the ratio of the infeed rate of the rolling stock into the roll stand to a maximum adjustment rate of the work rolls of the roll stand for influencing the thickness of the rolling stock is less than 3500, in particular less than 2000, in particular between 200 and 1500.

In a further embodiment, a twin-roll casting machine or a direct strip casting machine is used as the casting device.

In a further embodiment, a control device for a combined continuous casting and rolling system for producing rolling stock that is thickness-profiled in the longitudinal direction, incorporating a machine-readable program code which comprises control commands which cause the control device to carry out the method as claimed in one of the preceding claims.

Another embodiment provides a combined continuous casting and rolling system for producing rolling stock that is thickness-profiled in its longitudinal direction, wherein during steady-state operation the rolling stock extends continuously from the casting device to a roll train comprising at least one roll stand, having a control device as disclosed above, wherein the control device is operatively connected to the roll train.

In a further embodiment, the roll train comprises a roll stand having a set of work rolls which have a diameter of less than 800 millimeters, in particular 200 to 600 millimeters, wherein the roll stand is designed and operated such that the ratio of the infeed rate of the rolling stock into the roll stand to a maximum adjustment rate of the work rolls of the roll stand for influencing the thickness of the rolling stock is less than 3500, in particular less than 2000, in particular between 200 and 1500.

In a further embodiment, the casting device is also operatively connected to the control device as claimed in claim 11.

In a further embodiment, the casting device is implemented as a twin-roll casting machine or as a direct strip casting machine.

BRIEF DESCRIPTION OF THE DRAWINGS

Exemplary embodiments will be explained in more detail below on the basis of the schematic drawings, wherein.

DETAILED DESCRIPTION

Figure 1:
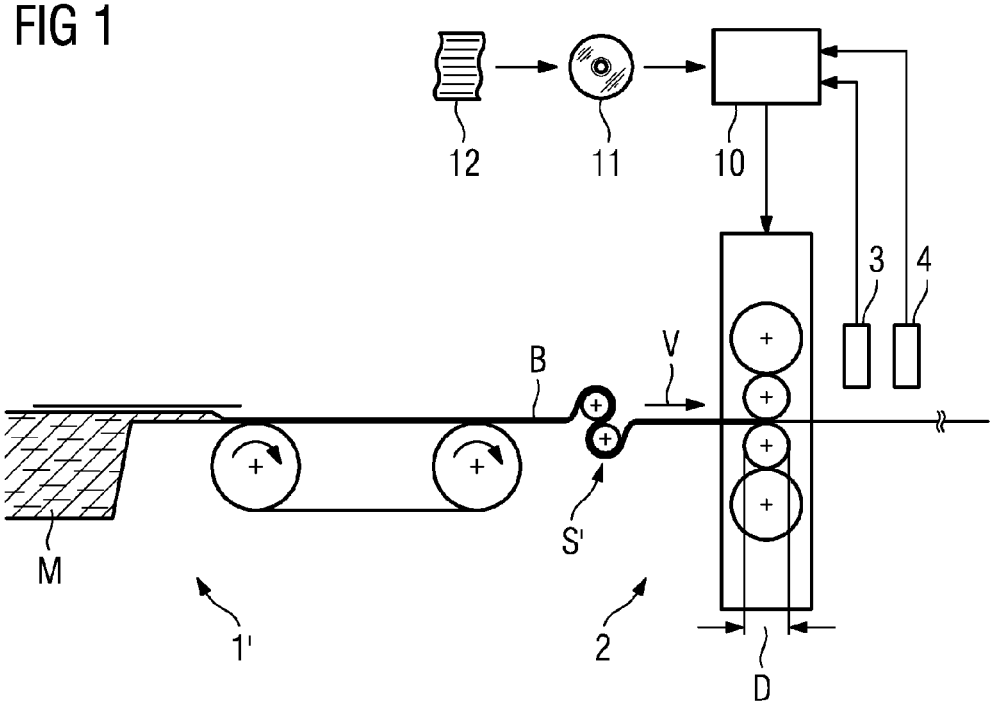
FIG. 1 schematically illustrates a combined continuous casting and rolling system having a direct strip casting machine, FIG. 2 schematically illustrates a combined continuous casting and rolling system having a vertically casting twin-roll casting machine, FIG. 3 schematically illustrates a combined continuous casting and rolling system having a horizontally casting twin-roll casting machine.

Embodiments of the present disclosure provide a method and an apparatus by means of which longitudinally profiled rolling stock can be produced considerably more inexpensively than using conventional processes.

For example, some embodiments provide a method for producing rolling stock, in particular metal strip, by means of a combined continuous casting and rolling system, comprising a casting device for casting metal and a roll train comprising at least one roll stand for hot forming the metal, wherein the combined continuous casting and rolling system is operated such that the rolling stock extends continuously between the casting device and the roll train, wherein rolling stock is continuously fed to the roll train, wherein a target thickness progression according to which the roll train rolls the rolling stock is predetermined for the roll train, wherein the thickness progression has at least two different target thicknesses for different sections in the longitudinal direction of the rolling stock, and that the thickness progression is designed such that the first and/or the second target thickness is set at least twice, wherein the combined continuous casting and rolling system is operated such that the speed of the rolling stock directly upstream of the roll stand in the mass flow direction is set to less than 7 meters per second, in particular less than 5 meters per second.

Rolling stock is here to be understood as meaning in particular a metal strip. Alternatively, however, it can be a long product such as wire, bar steel or steel sections or sections made of a nonferrous metal such as aluminum or magnesium. The terms "metal strip" and "hot strip" will be used hereinafter as synonyms for "rolling stock", so that the disclosed subject matter is not limited only to strip products.

Using a combined continuous casting and rolling system, the units of which are linked by the single-piece rolling stock, allows longitudinally profiled hot strip to be produced even during hot rolling, because, due to the combined continuous casting and rolling, the speed of the strip as it exits the hot rolling train is in general essentially determined by the pouring rate and the thickness reduction carried out by the system. Because of this linking, maximum strip speeds that are significantly below the usual strip speeds of 10 to 20 meters per second for conventional hot rolling mills not operating in linked mode are achieved in the roll train.

In addition, particularly in the case of thin strip casting or thin slab casting, the thickness range required for "tailored blanks" can be well covered.

Any casting machines suitable for combined continuous casting and rolling systems can be used as casting devices.

It is therefore possible to cost-effectively impart a longitudinal profile to the hot strip using one roll stand.

As a result, a flexible cold rolling step can be dispensed with completely. An entire system section, namely the cold rolling mill for producing longitudinally profiled rolling stock, can therefore be dispensed with, resulting in significant savings in terms of capital costs and operating costs.

Any thickness progressions can be predetermined as the thickness progression in the longitudinal direction, depending on the requirements of the purchasers of the resulting product. In particular, recurrent thickness profiles in the longitudinal direction can be very efficiently produced in this manner.

In one embodiment of the method, in addition to the at least two different target thicknesses, associated target roll forces and/or target roll gap openings can be predetermined, thereby further increasing the accuracy for producing a longitudinally profiled rolling stock.

In one embodiment, the thickness progression incorporates repeating, in particular recurring, thickness changes in the longitudinal direction of the rolling stock. This effectively enables large batch quantities of metal sheets profiled in the longitudinal direction to be produced which are cut directly from the rolling stock after rolling, for example.

In one embodiment of the method, a strip accumulator, in particular a loop of strip, with which mass flow fluctuations in the combined continuous casting and rolling system caused by the thickness progression are compensated is provided between the casting device and the roll train. This is possible in a particularly simple and effective manner in the case of combined continuous thin strip casting and rolling systems, because, due to the small diameter of the cast metal strip in the case of thin strip casting, the cast strip already exhibits sufficient deformability, allowing e.g. a loop of strip caused by gravity to be formed between roll stand and casting device. This can be used as a strip accumulator between casting device and roll train. An accumulator is therefore very advantageous, as the mass flow fluctuations in the combined casting and rolling system, in particular in the roll train,—caused by the thickness variations in the longitudinal direction of the metal strip—can be compensated thereby. This in turn allows, for example, strip cracking to be prevented.

The accumulator can be implemented in particular as a looper which is operated such that mass flow fluctuations in the combined continuous casting and rolling system caused by the thickness progression are compensated.

In another variant, the casting device is operated so as to produce a predetermined actual rolling stock thickness progression matched to the target thickness progression before the rolling stock enters the roll train, the casting device thereby assisting the at least one roll stand in the longitudinal profiling of the rolling stock. In particular, this enables high rolling forces to be avoided and undesirable processing speed fluctuations between casting device and roll train to be reduced. By means of the corresponding sharing of the setting of the thickness progression between casting device and roll train, it is possible for the roll stand always to be operated such that it does not come up against system-related or technological limits in setting the target thickness progressions. System-related limits are, for example, the set position and/or speed of the work rolls, technological limits are, for example, thickness reductions which, although they would be required for setting the target thickness progression, result in no longer tolerable deviations e.g. in the flatness of the rolling stock. This can be prevented if the longitudinal profiling of the rolling stock is shared between the casting device and roll train.

In another embodiment, a thickness measuring device for detecting the rolled thickness of the rolling stock is disposed downstream of the roll train in the mass flow direction, wherein at least one final control element for the roll train is set as a function of the measured thickness and the predetermined thickness progression. This enables a comparison to be made between the desired target thickness for a section rearward of the roll stand and the actually obtaining actual thickness for that section. On this basis, improved setting of the final control elements and/or model adaptation can be performed which provides a closer approximation of the actual thickness rearward of the roll stand to the desired target thickness rearward of the roll stand for future sections to be rolled.

In addition, the roll train may be followed in the mass flow direction by a flatness measuring device for measuring the flatness of the rolling stock, wherein at least one final control element, in particular a bending cylinder, for the roll train is set as a function of the measured flatness and a predetermined thickness progression. This ensures that, on the one hand, a desired thickness progression is set and, on the other, that the flatness requirements placed on the rolling stock are met.

In one embodiment of the method, the thickness progression is set using a roll train which comprises one roll stand having a set of work rolls having a diameter of less than 800 millimeters, in particular 200 to 600 millimeters.

The infeed rate may be set and the roll stand designed such that the ratio of the infeed rate of the rolling stock into the roll stand to a maximum adjustment rate of the work rolls of the roll stand for influencing the thickness of the rolling stock is less than 3500, in particular less than 2000, in particular between 200 and 1500. The above ratio may be maintained for all the operated roll stands of a roll train if the roll train comprises more than one roll stand. The infeed rate can generally be influenced, i.e. controlled, by means of the pouring rate. By using work rolls having a diameter of less than 800 mm in combination with said ratio of infeed rate to maximum adjustment rate of the roll stand, thickness progressions can be set which basically provide all the required thickness gradients for producing longitudinally profiled rolling stock. This allows virtually all the thickness profiles required by customers to be implemented during hot rolling. In particular, if the above ratio of infeed rate to maximum adjustment rate is maintained, sufficient dynamics are available for the roll stand to process the rolling stock in the required manner. Thickness gradient is to be understood as meaning the change in thickness per unit length of the rolling stock, i.e. in the longitudinal direction of the rolling stock. Adjustment rate is to be understood as meaning the hydraulic adjustment rate for adjusting the work rolls under load conditions.

The disclosed method may be used for combined continuous casting and rolling systems in which a twin-roll casting machine or a direct strip casting machine is used, because these casting devices are thin strip casting units. The rolling stock, in particular metal strip, produced by the casting device is generally already relatively thin, in particular having a thickness of less than 3 mm. This allows, on the one hand, final thicknesses in the region of 0.7 mm or less to be produced with at the same time comparatively low infeed rates to the roll train. Possible casting devices include, in particular, twin-roll casting machines in which the two rolls are disposed in a vertical plane, i.e. the metal is cast horizontally. These systems can be used, for example, for aluminum, magnesium, zinc, etc., i.e. for "soft" metals. In addition, twin-roll casting machines can also be used in which the rolls are disposed in a horizontal plane, i.e. the metal is cast vertically, as is usual e.g. for carbon steels and other steels.

Other embodiments provide a control device for a combined continuous casting and rolling system for producing rolling stock that is thickness profiled in the longitudinal direction, comprising a machine-readable program code containing control commands which cause the control device to carry out the method as claimed in one of claims 1 to 10. In particular, the control device can comprise a plurality of modules designed to implement the individual steps of the embodiments of the disclosed method in a machine-readable manner so that these steps can be initiated by the control device.

Some embodiment provide a combined continuous casting and rolling system for producing rolling stock that is thickness-profiled in its longitudinal direction, wherein during steady-state operation of the combined continuous casting and rolling system the rolling stock extends continuously from the casting device to a roll train comprising at least one roll stand, having a control device as claimed in claim 11, wherein the control device as claimed in claim 11 is operatively connected to the at least one roll stand, thereby providing an apparatus with which longitudinally profiled rolling stock can be produced during hot rolling.

In one embodiment of the apparatus, the roll train comprises a roll stand having a set of work rolls having a diameter of less than 800 millimeters, in particular 200 to 600 millimeters, wherein the roll stand is designed and operated such that the ratio of the infeed rate of the rolling stock into the roll stand to a maximum adjustment rate of the work rolls of the roll stand for influencing the rolling stock thickness is less than 3500, in particular less than 2000, in particular between 200 and 1500. If the combined continuous casting and rolling system has a roll train comprising more than one roll stand, the above ratio may be maintained for each roll stand. This provides an apparatus whereby virtually all the thickness profiles required by customers can be implemented during hot rolling, as corresponding thickness gradients are rollable.

The casting device may also be operatively connected to the control device as claimed in claim 11. This enables the thickness progression and therefore the load of the individual units for producing the required target thickness for a section to be expediently shared between casting device and roll train. Via rolling stock or strip tracking, the section cast according to the presettings of the control device is then processed in a time-correct and positionally correct manner by the roll train such that the section exiting the roll train has as far as possible the desired target thickness. This prevents, for example, individual final control elements of the roll train for producing the required thickness progression from operating at their limits or eliminates technological problems, such as flatness defects caused by e.g. excessively large thickness reductions in the roll stand.

The casting device may be implemented as a twin-roll casting machine or as a direct strip casting machine. The advantages arise in accordance with the above explanations relating to the corresponding method claim.

FIG. 1 shows a combined continuous casting and rolling system, comprising a direct strip casting machine 1' with which molten metal M is poured onto a revolving casting belt. The metal solidifies to produce a thin metal strip B as rolling stock which can be further processed in the combined continuous casting and rolling system.

The combined continuous casting and rolling system additionally comprises a roll train 2. The roll train 2 can have one roll stand or also a plurality of roll stands. The roll train 2 is used to hot form the metal strip B, in particular to roll the metal strip B to its final thickness.

The metal strip B extends continuously from the direct strip casting machine 1' to the roll train 2. All the units of the combined continuous casting and rolling system are generally interlinked via the metal strip B, i.e. during steady-state operation of the combined continuous casting and rolling system.

Disposed between the roll train 2 and the direct strip casting machine 1' is an accumulator S'. The accumulator S' is implemented as a pair of S-rolls. The rotation of the roll pair about a pivot point located between the rolls allows the length of strip fed via the rolls to be changed, thereby enabling an accumulator volume to be provided.

Provided downstream in the mass flow direction of the roll train 2 is a thickness measuring device 3 and a flatness measuring device 4. These can be of any design. Such devices will be sufficiently well-known to the average person skilled in the art. They can also if necessary be disposed upstream of the roll train 2 in the mass flow direction so that the at least one roll stand of the roll train 2 can be operated in a pre-controlled manner, i.e. the measured section, hereinafter referred to as the strip section, still passes through the roll stand, thereby enabling said strip section still to be controlled in the desired manner.

The flatness measuring device 4 and the thickness measuring device 3 are operatively connected to a control device 10 which controls the roll train 2 in an open-/closed-loop manner such that the desired thickness progression in the longitudinal direction of the metal strip B is produced.

The flatness and thickness data acquired is fed to the control device 10. The roll train 2 is operated on the basis of this data and on the basis of the predetermined target thickness progression.

Machine-readable program code 12 enables the control device 10 to operate the roll train 2 according to an embodiment of the disclosed method. The machine-readable program code 12 is stored e.g. using a storage medium 11 on the control device 10. In addition, target thickness progressions to be rolled for the metal strip B can be specified using the control device 10.

During operation, the infeed rate V of metal strip B to the roll stand is set such that the infeed rate of the metal strip B of 5 meters per second is not exceeded for any of the roll stands incorporated in the roll train 2. This can be achieved by appropriate setting of the pouring rate.

In addition, to produce the thickness progressions in the longitudinal direction of the metal strip B, work rolls having a diameter D of 500 millimeters are used. As a result of the reduced diameter D of the work rolls compared to the work rolls normally used for hot rolling—these often having a diameter of around 1000 mm—the rolling forces applied to the metal strip B can be increased, thereby enabling greater thickness reductions to be achieved. At the same time, higher thickness gradients can be rolled. In addition, the work rolls for influencing the thickness can be adjusted with an adjustment rate of max. 4 millimeters per second.

As a result, a maximum ratio of infeed rate V to adjustment rate of 1250 is achieved which is ideally suitable for thickness profiling of the metal strip B in the longitudinal direction.

Because of the thickness profiling in the longitudinal direction of the metal strip B, fluctuations in the infeed rate V of the metal strip B to the roll train or more specifically to a roll stand generally occur. These fluctuations are compensated by means of the accumulator S' so that, as far as possible, constant traction is implemented for the metal strip B during the flexible hot rolling process.

Figure 2:
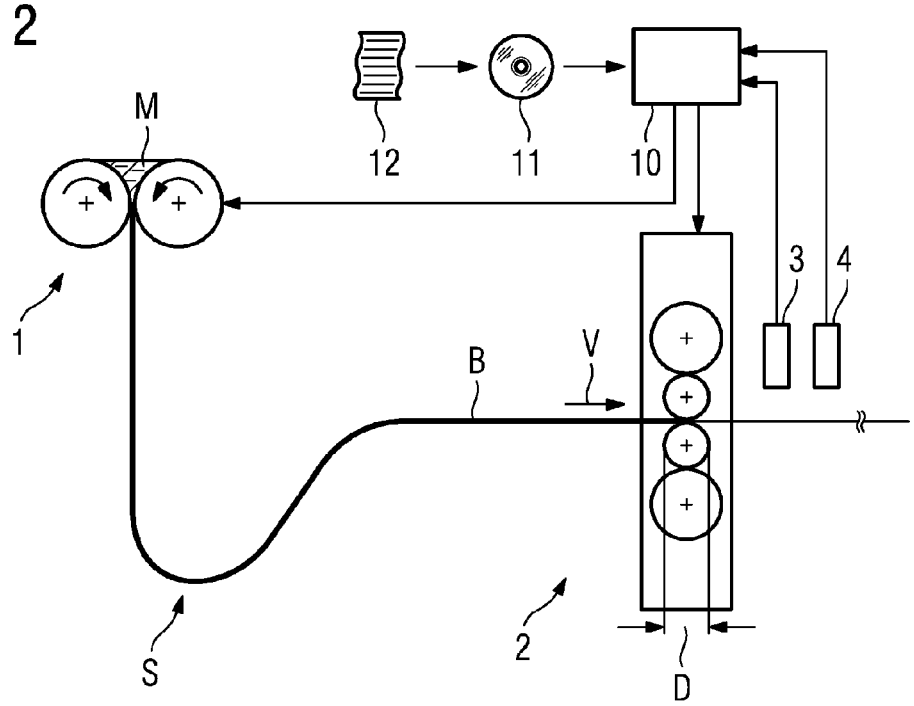

FIG. 2 shows a combined continuous casting and rolling system, comprising a twin-roll casting machine 1 for vertical casting of molten metal M. The casting and rolling system additionally comprises a roll train 2 in which the cast metal is rolled to its final thickness. As in the case of FIG. 1, the roll train can comprise one roll stand or a plurality of roll stands.

The metal strip B cast by the twin-roll casting machine 1 forms a loop S caused by gravity and then enters a roll train 2 comprising at least one roll stand.

Similarly to the combined continuous casting and rolling system described with reference to FIG. 1, the roll train 2 or rather the roll stand is followed in the mass flow direction by a thickness measuring device for measuring the thickness of the metal strip B as it exits the roll train 2.

In addition, a flatness measuring device 4 is likewise disposed downstream of the roll train 2 in the mass flow direction. The thickness measuring device 3 and the flatness measuring device 4 are operatively connected to a control device 10 to which the data acquired is fed.

As described in connection with in FIG. 1, the control device 10 is configured to implement an embodiment of the disclosed method. In this case the control device 10 is operatively connected to the roll train 2 on the one hand and to the casting device 1 on the other for this purpose.

The control device 10 has overall control of the setting of the required thickness progression in the longitudinal direction for the metal strip B, i.e. the control device 10 already causes the molten metal M to be cast with an appropriate thickness profile in the longitudinal direction on the basis of the required target thickness progression, so that the metal strip B already has varying thicknesses in the longitudinal direction when it enters the roll train 2. This preliminary thickness profile produced by the casting device 1 is then rolled over by the at least one roll stand of the roll train 2 such that the required target thickness profile is obtained in the longitudinal direction. This enables the required load for the desired thickness profiling to be shared between the units, so that the roll train 2 does not come up against system-related limits when rolling the longitudinal profile of the metal strip B.

In addition, as well as the preliminary thickness profile, the pouring rate of the twin-roll casting machine 1 is controlled such that the ratio of the infeed rate V of the metal strip B into the roll stand and the adjustment rate of the work rolls for roll stand thickness influencing is less than 2000. For this purpose a roll stand having an adjustment rate of 3 millimeters per second is used and a pouring rate of 2 meters per second is set. This provides a ratio of approximately 670 with which it is possible to produce required thickness profiles in the longitudinal direction in the desired manner and within the technical limits of the system. Particularly advantageously, this can be combined with work rolls having diameters of less than 800 millimeters.

Figure 3:
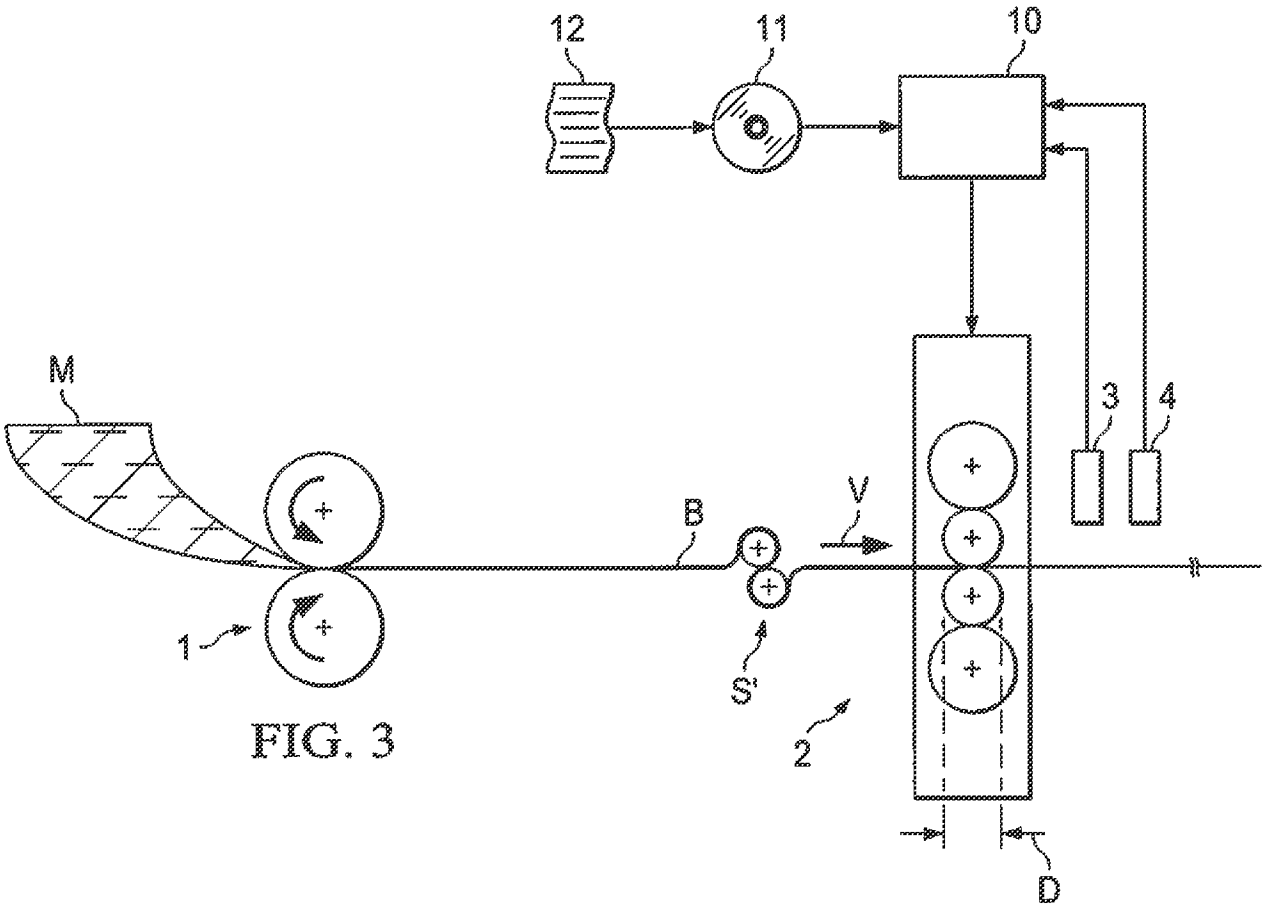

FIG. 3 shows a combined continuous casting and rolling system, comprising a twin-roll casting machine 1 for horizontal casting of molten metal M. In contrast to FIG. 2, the casting rolls are disposed such that the metal can be cast horizontally and not vertically. In addition, in the system according to FIG. 3 no loop of cast metal strip is formed, so that—as in FIG. 1—a looper may be provided between casting device 1 and roll train 2.

One reason for casting horizontally and not vertically lies in the tensile strength of the metal to be cast. Whereas in a system as shown in FIG. 2 a loop is formed, the dead weight of which is supported by the strip, this loading of the strip can be avoided in a system according to FIG. 3. The latter is therefore generally to be used for casting metals and alloys whose tensile strength is too low to support the dead weight of a loop as shown in FIG. 2. Examples of such metals include magnesium, zinc or aluminum.

Otherwise, the statements with respect to FIG. 2 essentially apply analogously to FIG. 3. In particular, the roll train, the flatness measuring device or the thickness measuring device do not differ substantially from the embodiment according to FIG. 2. The statements with respect to FIG. 2 for these parts are directly applicable to FIG. 3.

In particular, the rolling operation generally takes place independently of whether the metal is cast horizontally or vertically. It is merely necessary to consider any changed pouring rates, material strengths, etc. and adapt them to the rolling operation accordingly.

Figure 4:
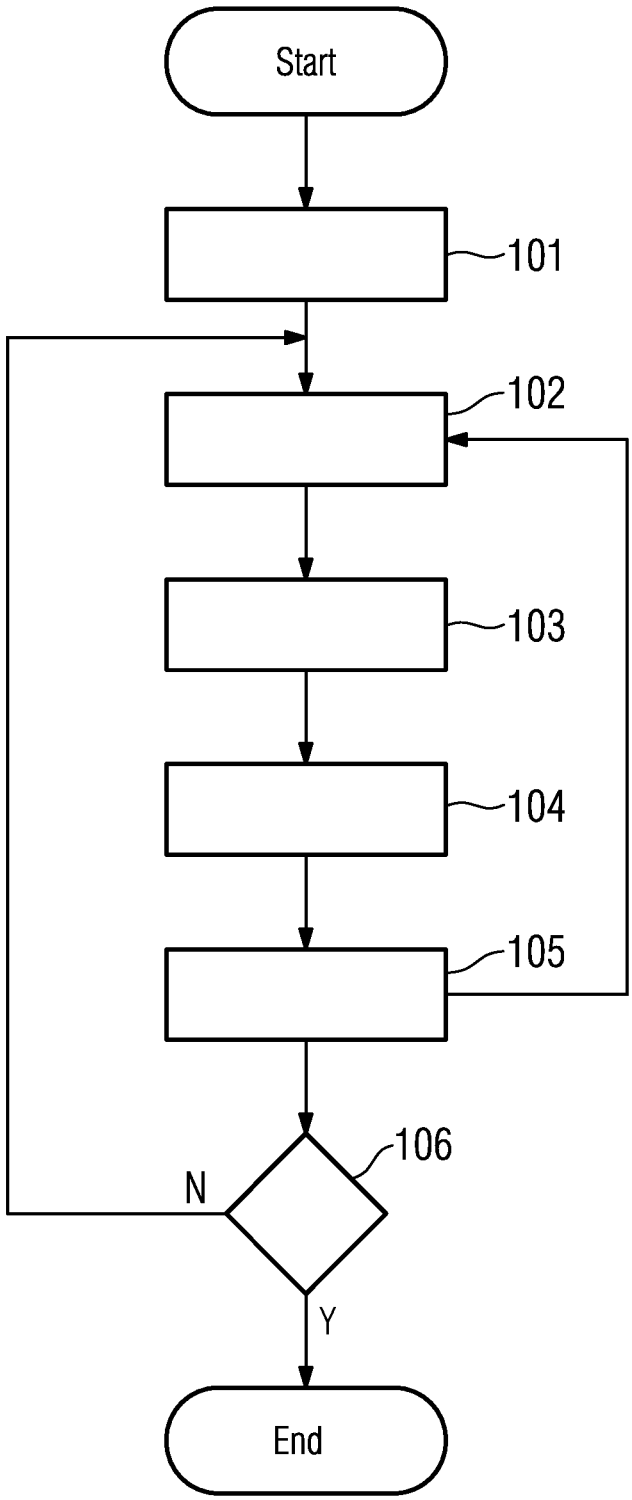
FIG. 4 shows a flow chart schematically illustrating an embodiment of the method.

FIG. 4 shows a typical flow chart for an embodiment of the disclosed method. In the flow chart it is assumed that the combined continuous casting and rolling system is in steady-state operation, a twin-roll casting machine as shown in FIG. 2 being used as the casting device.

In a step 101, a target thickness progression in the longitudinal direction of the metal strip B is predetermined for the hot strip to be rolled. This predefines, for example, a recurring thickness progression for the metal strip.

In a step 102, a manipulated variable for the casting device and the roll train is determined on the basis of the predetermined thickness profile from step 101. In particular, a thickness progression to be provided by the casting device is determined. This is generally different from the thickness progression in the longitudinal direction to be provided by the roll train, as the casting rolls can only produce a comparatively imprecise thickness progression. However, this thickness progression significantly facilitates the processing of the metal strip B in respect of providing the target thickness progression. In addition, a thickness progression is determined for the roll train such that the metal strip B exits the roll train with an actual thickness progression in the longitudinal direction which essentially corresponds to the target thickness progression in the longitudinal direction of the metal strip B.

The casting rolls of the casting device are controlled by the control device such that the predetermined thickness progression is present prior to entry to the roll train. In addition, the casting device is controlled by means of the control device as a function of the maximum adjustment rate of the roll stand such that the infeed rate to the roll train is below an appropriate threshold value, e.g. 3 meters per second. This ensures that the ratio of strip infeed rate into the roll stand to adjustment rate of the work rolls for influencing the metal strip thickness is such that the required thickness profile can also be produced. This is generally possible if the ratio between strip infeed rate and adjustment rate for each roll stand of the roll train is less than 3500, in particular between 200 and 1500.

A plurality of operating points that are to be passed through by the roll stand for a particular strip section are provided for the target thickness progression. These operating points predefine, for example, not only the target thickness but also a target roll force and a target roll gap for the roll stand. These operating points may be determined using a process model.

In a step 103, the corresponding strip section is cast according to the thickness progression specified for the casting device.

The corresponding strip section then enters the roll train and is rolled in accordance with the predetermined thickness progression in a step 104 such that the strip section has an actual thickness progression which essentially corresponds to the predetermined target thickness progression for that strip section.

The thickness of the metal strip B may be controlled in a closed-loop manner, in particular using detected adjustment positions for the work rolls, detected roll forces, detected thicknesses and/or detected profiles of the metal strip B.

In particular, a thickness measurement and a flatness measurement are carried out in a step 105. The data obtained from the measurements is fed to the control device which, on the basis of this data, influences final control elements of the roll stand such that the actual thickness and actual flatness are more closely approximated to the target thickness and target flatness respectively for subsequently rolled sections of strip.

In a step 106, it is interrogated whether the process is to be terminated. If not, the process is continued until it is intended to be terminated.

Such a procedure can be implemented for all the types of equipment as shown in FIGS. 1 to 3, but it not restricted either to the sequence as such or to the types of equipment as shown in FIG. 1 to FIG. 3.

With correspondingly low rolling rates, the method can also be used for combined continuous casting and rolling systems which use, for example, a permanent mold as a casting device.

What is claimed is:

1. A method for producing rolling stock using a combined continuous casting and rolling system comprising a casting device for casting metal and a roll train having at least one roll stand for hot forming the rolling stock, the method comprising:

casting the metal and rolling the cast metal using a casting machine to form a hot rolling stock having two different thicknesses for different sections of the hot rolling stock in a longitudinal direction, continuously feeding the hot rolling stock having two different thicknesses in the longitudinal direction from the casting machine to a looper including a pair of S-rolls rotating about a pivot point between the pair of S-rolls, rotation of the pair of S-rolls compensating for mass flow fluctuations caused by thickness changes in the hot rolling stock as an accumulator and then to the roll train, and rolling the hot rolling stock with the roll train according to two predetermined target thicknesses for different sections of the hot rolling stock in a longitudinal direction, wherein the predetermined target thicknesses have at least two different target thicknesses for different sections in a longitudinal direction of the rolling stock exiting the roll train, the thicknesses being defined such that at least one of a first target thickness and a second target thickness is set at least twice, and wherein the combined continuous casting and rolling system is operated such that an infeed rate of the rolling stock to the at least one roll stand is set to less than 7 meters per second and the rolling stock extends continuously between the casting device and the roll train.

2. The method of claim 1, wherein the predetermined thicknesses define, in addition to the at least two different target thicknesses, associated target roll forces or target roll gap openings.

3. The method of claim 1, wherein the thicknesses define recurring changes in thickness in the longitudinal direction of the rolling stock.

4. The method of claim 1, comprising operating the casting device such that the casting device has predetermined actual thicknesses for the rolling stock that matches the target thicknesses before it enters the roll train.

5. The method of claim 1, comprising detecting a rolled thickness of the rolling stock by a thickness measuring device following the roll train in the mass flow direction, and setting at least one final control element for the at least one roll stand as a function of the detected thickness and the predetermined thicknesses.

6. The method of claim 1, comprising using a flatness measuring device following the roll train in the mass flow direction to detect a flatness of the rolling stock, and setting a bending cylinder for the roll train as a function of the detected flatness and predetermined thicknesses.

7. The method of claim 1, the roll train comprising at least one roll stand having a set of work rolls that have a diameter of less than 800 millimeters, the roll train setting the thicknesses.

8. The method of claim 7, wherein the infeed rate is set and the at least one roll stand designed such that a ratio of an infeed rate of the rolling stock into the at least one roll stand to a maximum adjustment rate of work rolls of the at least one roll stand for influencing the thickness of the rolling stock is less than 3500.

9. The method of claim 1, wherein the casting device comprises a twin-roll casting machine or a direct strip casting machine.

10. The method of claim 1, wherein the combined continuous casting and rolling system is operated such that an infeed rate of the rolling stock to the at least one roll stand is set to less than 5 meters per second.

11. The method of claim 1, wherein the combined continuous casting and rolling system is operated such that an infeed rate of the rolling stock to the at least one roll stand is set to between 1 meters per second and 4 meters per second.

12. The method of claim 1, wherein the infeed rate is set and the at least one roll stand designed such that the ratio of the infeed rate of the rolling stock into the at least one roll stand to a maximum adjustment rate of work rolls of the at least one roll stand for influencing the thickness of the rolling stock is less than 2000.

13. The method of claim 1, wherein the infeed rate is set and the at least one roll stand designed such that the ratio of the infeed rate of the rolling stock into the at least one roll stand to a maximum adjustment rate of work rolls of the at least one roll stand for influencing the thickness of the rolling stock is between 200 and 1500.

14. A method for processing stock with a combined continuous casting and rolling system having a casting device and a roll train with at least one roll stand for hot forming the stock, the method comprising:

casting the stock according to a specified thickness progression;

feeding the cast stock to the roll train, wherein the stock extends continuously between the casting device and the roll train;

compensating for mass flow fluctuations caused by thickness changes in the hot rolling stock with a looper including a pair of S-rolls rotating about a pivot point between the pair of S-rolls, rotation of the pair of S-rolls adjusting the length of strip fed to the roll train; and hot rolling the stock according to a progression of predetermined target thicknesses;

wherein the progression includes at least two different target thicknesses for different sections along a length of the stock, such that the target thickness is set at least twice; and an infeed rate of the stock to the roll stand is less than 7 meters per second.

* * * * *